US007906718B1

(12) United States Patent
Liao

(10) Patent No.: US 7,906,718 B1
(45) Date of Patent: Mar. 15, 2011

(54) DRUM AND DRUM STAND COUPLER

(76) Inventor: Tsun-Chi Liao, Taichung (TW)

( * ) Notice: Subject to any disclaimer, the term of this patent is extended or adjusted under 35 U.S.C. 154(b) by 0 days.

(21) Appl. No.: 12/683,446

(22) Filed: Jan. 7, 2010

(51) Int. Cl.
*G10D 13/08* (2006.01)

(52) U.S. Cl. ..... 84/411 R; 84/421

(58) Field of Classification Search ..... 84/411 R, 84/421

See application file for complete search history.

(56) References Cited

U.S. PATENT DOCUMENTS 7,528,312 B1 * 5/2009 DiGiovanni ..... 84/411 R

* cited by examiner

*Primary Examiner* — Kimberly R Lockett
(74) *Attorney, Agent, or Firm* — Muncy, Geissler, Olds & Lowe, PLLC

(57) ABSTRACT

A drum and drum stand coupler comprises a first coupler and a second coupler that respectively surround the circumference of a drum shell at an upper side and a lower side. The first and second couplers have respectively an adjustment slot on the left and right sides run through by a transverse fastener to couple to a longitudinal fastener of a drum. The coupler also includes a distance adjustment means to couple longitudinally the first and second couplers. The distance adjustment means includes a first guiding member and a second guiding member that are coupled in an up and down manner and staggered on the outer side and inner side, and run through by at least one fastening element to be fastened together. Thus multiple drums with varying heights can mate drum shells with different specifications. The distance adjustment means also has a fixture to couple with a drum stand.

9 Claims, 6 Drawing Sheets

DRUM AND DRUM STAND COUPLER

FIELD OF THE INVENTION

The present invention relates to a coupler and particularly to a coupler to couple a drum and a drum stand.

BACKGROUND OF THE INVENTION

On percussion instruments, a drum stand usually is used to hold drums of different sizes. Referring to FIG. 1, a conventional drum has an upper side and a lower side coupled respectively with an upper drum rim a and a lower drum rim b, and a plurality of lugs c attached annularly on the drum shell at the upper side and lower side. The upper drum rim a and each lug c at the upper side of the drum shell are fastened by a bolt d longitudinally running through the lug c to hold an upper drum head of the drum tightly. Similarly, the lower drum rim b and each lug c at the lower side of the drum shell also are fastened by another bolt d longitudinally running through the lug c to hold a lower drum head of the drum tightly. A conventional drum and drum stand coupler includes an upper coupler 1 and a lower coupler 2. The upper coupler 1 has a top and the lower coupler 2 has a bottom that are extended horizontally leftwards and rightwards in an arched manner to form a wing 3. The wing 3 has a slot running through up and down and coupled with an elastic pad 4. The pad 4 has a longitudinal hole run through by the bolt d to engage with the lug c to fasten the drum and the coupler together. The upper coupler 1 further has a plate 5 extended longitudinally downwards. The plate 5 has side plates 6 respectively on the left side and right side bent towards the drum. Each side plate 6 has a longitudinal sliding slot. The lower coupler 2 has a pair of upright planks 7 located longitudinally upwards on the left side and right side to be disposed on the inner side of the side plate 6 in a staggered manner. The upright plank 7 has a strut 8 on an outer side coupled in the sliding slot. The side plate 6 has a bolt 9 on an outer side running through the sliding slot to fasten the upright plank 7. Thus the upper coupler 1 and the lower coupler 2 can be fastened together. The plate 5 further is fastened to a fixture f on the surface to couple with a drum stand (not shown in the drawing).

The drums of different sizes generate different sound, and the drum height and the size of the drum shell impacts the sound. The coupler has to couple with drums of varying heights and different drum shells and also couple to a drum stand. The conventional coupler previously discussed can adjust only the elevation distance of the upper and lower couplers 1 and 2, but is not adaptable to the drum shells of greater size differences.

SUMMARY OF THE INVENTION

The primary object of the present invention is to solve the shortcoming of the conventional drum and drum stand coupler that is not adaptable to drum shells of greater size differences. The present invention provides a drum and drum stand coupler that has a first coupler and a second coupler each has an adjustment slot on the left side and right side run through by a transverse fastener to couple with a longitudinal fastener on the outer side of the drum shell. Thus it is applicable to the drum shells of greater size differences to fasten the drums and drum stand.

To achieve the foregoing object, the drum and drum stand coupler according to the present invention is to hold a drum which includes an upper drum rim and a lower drum rim, and a drum shell with a plurality of lugs attached annularly on the upper side and lower side thereof. The upper drum rim, lower drum rim and lugs are coupled through a plurality of longitudinal fasteners. The coupler of the present invention comprises a first coupler, a second coupler and a distance adjustment means.

The first and second couplers are formed in an arched shape and located on the circumference at the upper side and lower side of the drum shell, and have respectively an elongate adjustment slot on the left side and right side run through by a transverse fastener to couple with the longitudinal fastener.

The distance adjustment means longitudinally couples the first and second couplers, and comprises a first guiding member and a second guiding member. The first guiding member has an upper end fastened to the first coupler. The second guiding member has a lower end fastened to the second coupler. The first and second guiding members are plates coupled in an up and down manner and staggered on an outer side and an inner side, and are coupled together through at least one fastening element.

By means of the structure set forth above, the elongate adjustment slot of the first and second couplers can be run through by the transverse fastener to couple to the longitudinal fastener. Thus it can be used to couple a plurality of drums with greater size differences of drum shells with a drum stand. Moreover, the first and second guiding members are formed in plates in contact with each other on the outer side and inner side, thus can withstand a greater strength to prevent vibrating.

In addition, as the first and second guiding members are coupled in an up and down manner and staggered on the outer side and inner side, the longitudinal distance of the first and second couplers can be adjusted according to varying heights of the drums. Moreover, the fastening elements are positioned in a three-point manner to couple the first and second couplers, hence a firmer fastening effect can be achieved.

The foregoing, as well as additional objects, features and advantages of the invention will be more readily apparent from the following detailed description, which proceeds with reference to the embodiment and accompanying drawings. The embodiment serves merely for illustrative purpose and is not the limitation of the invention.

DETAILED DESCRIPTION OF THE PREFERRED EMBODIMENT

Figure 1:
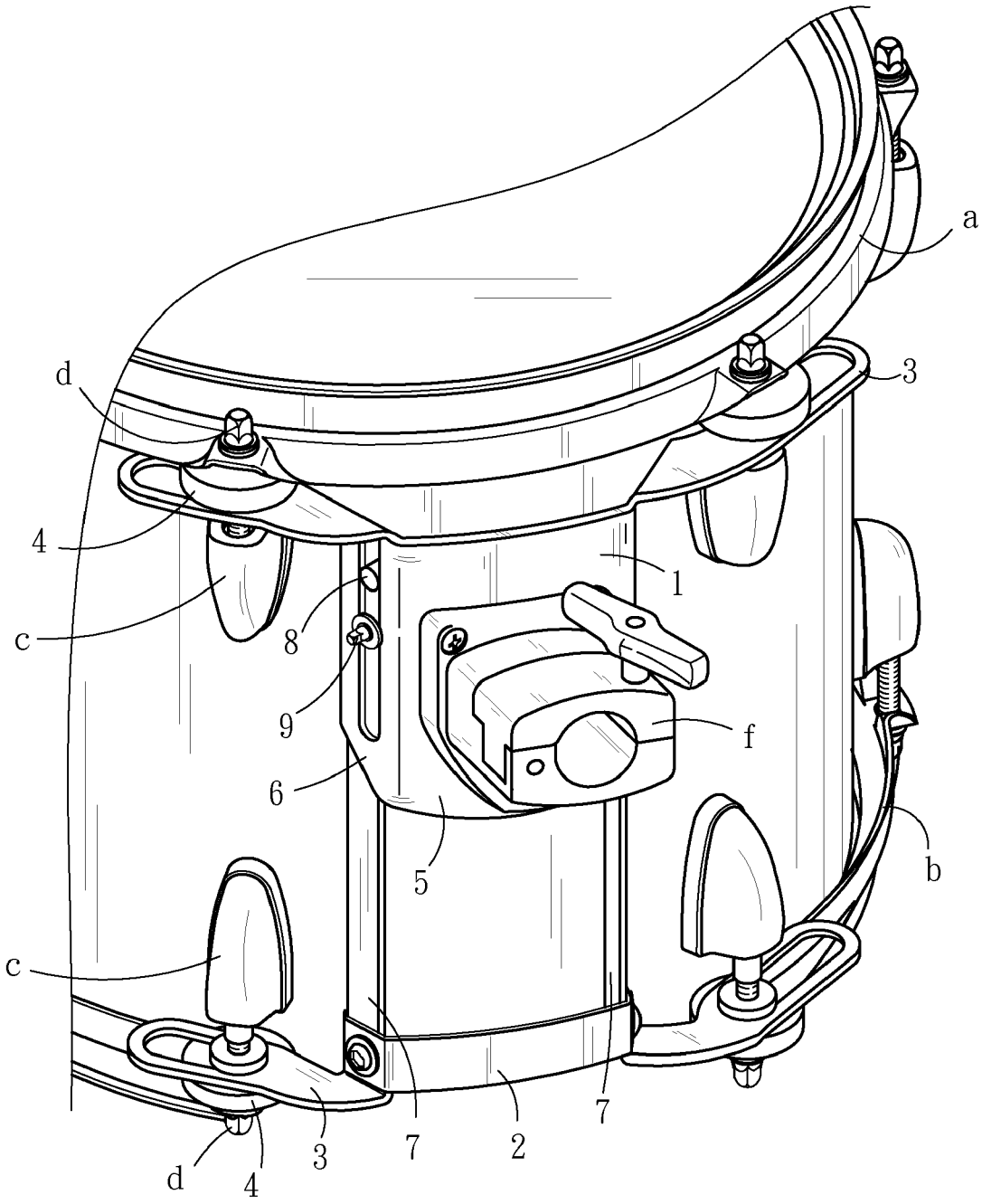
Fig. 1 PRIOR ART
FIG. 1 is a fragmentary perspective view of a conventional coupler and a drum.
Figure 2:
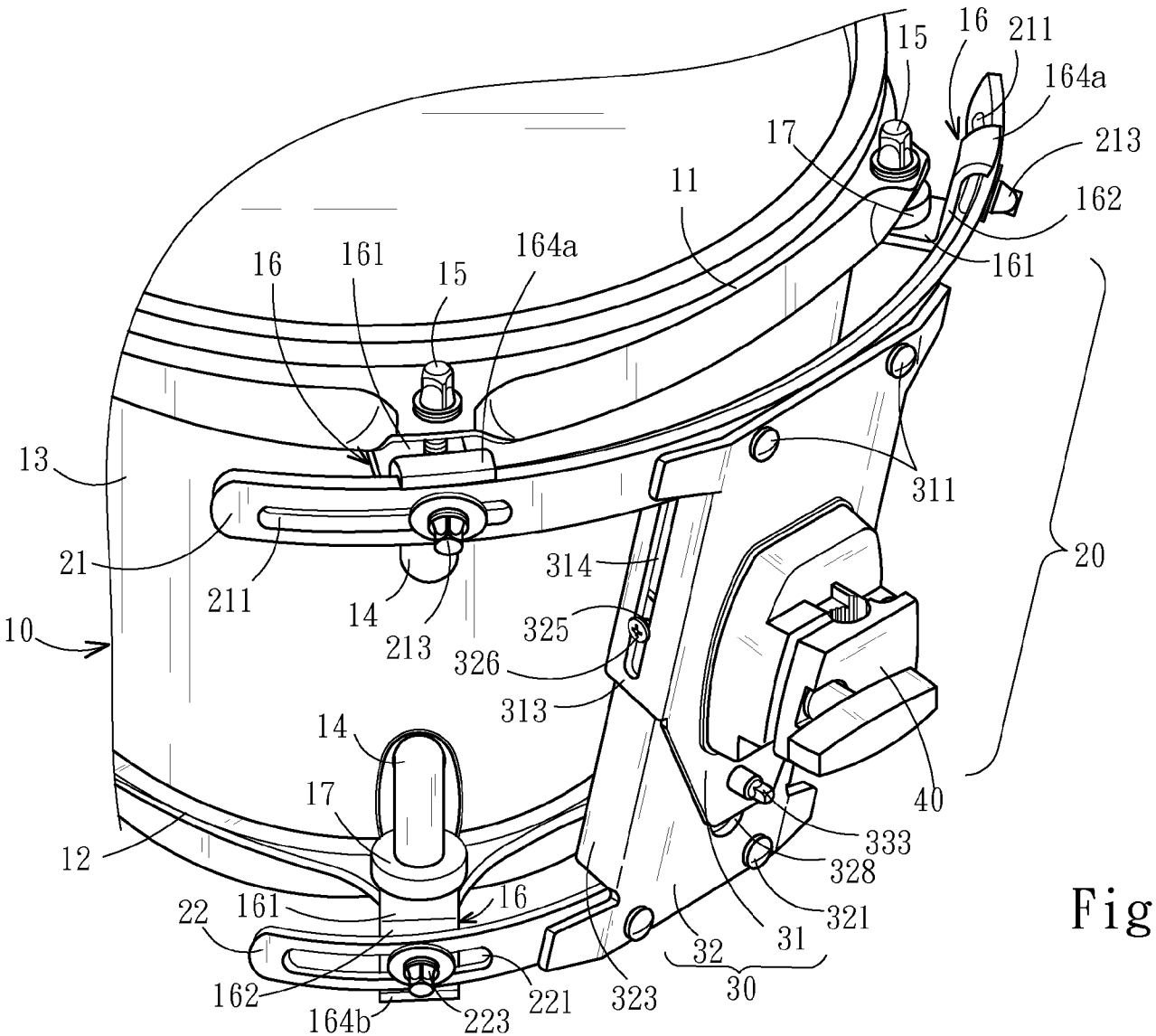
FIG. 2 is a fragmentary perspective view of the coupler and a drum according to the present invention.
Figure 3:
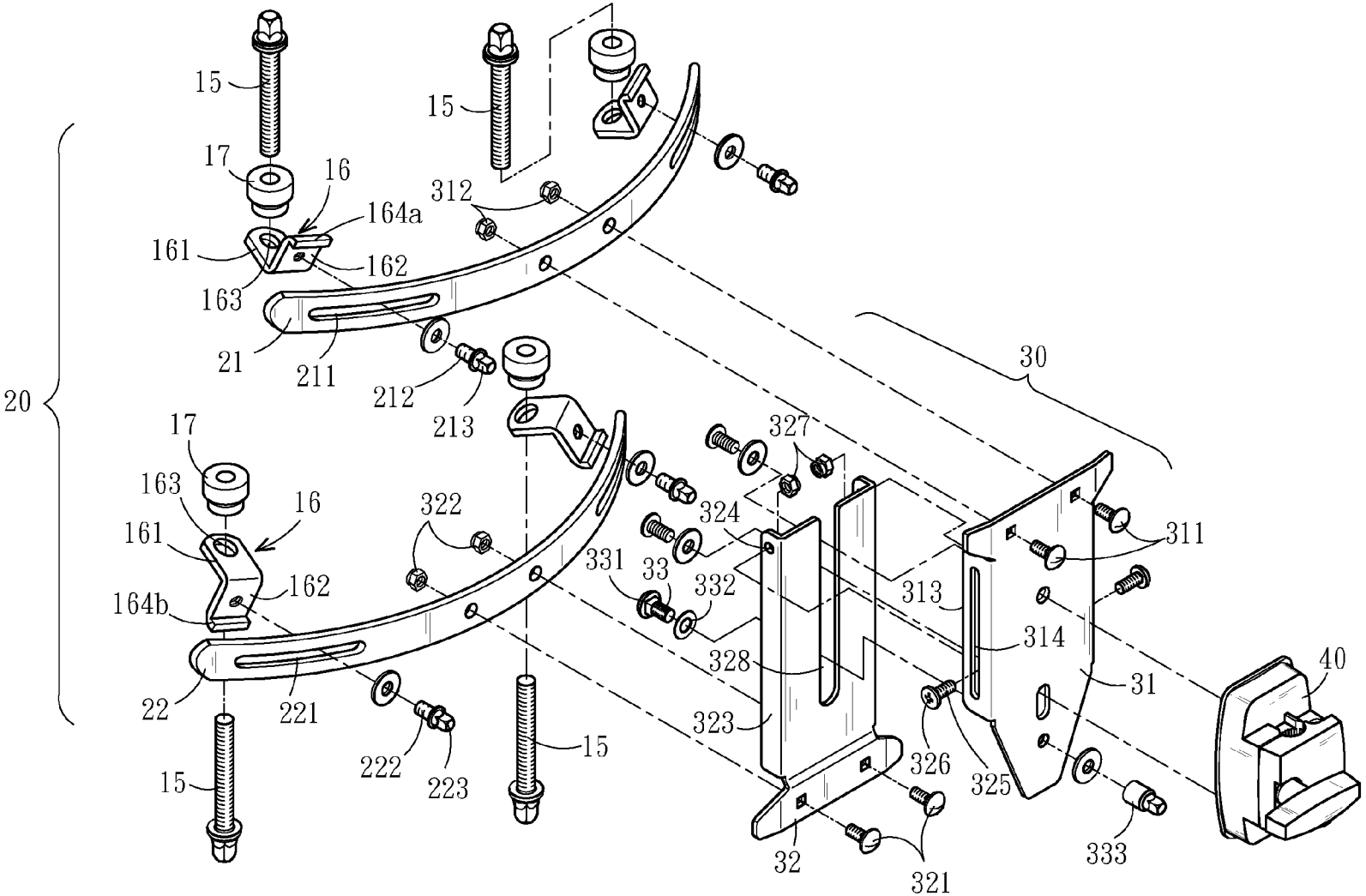
FIG. 3 is an exploded view of the coupler of the present invention.
Figure 4:
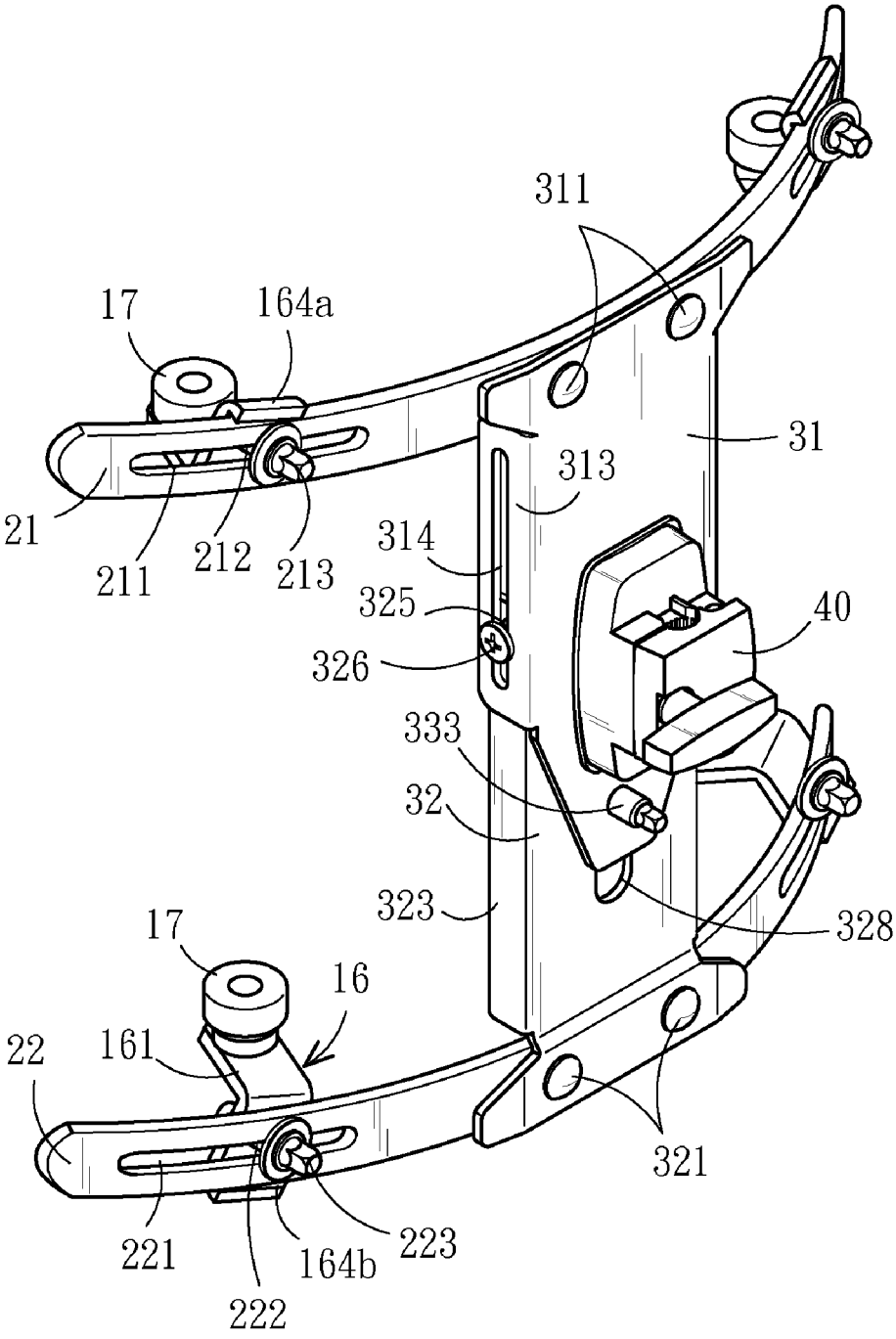
FIG. 4 is a perspective view of the coupler of the present invention.

Please refer to FIGS. 2 through 4, the present invention aims to provide a drum and drum stand coupler. The drum 10 has an upper drum rim 11 and a lower drum rim 12 and a drum shell 13. There are a plurality of lugs 14 attached annularly to the outer side of the drum shell 13 at the upper side and lower side. The upper drum rim 11 and lower drum rim 12 are coupled to the lugs 14 at the upper side and lower side of the drum shell 13 through a plurality of longitudinal fasteners (such as bolts) 15. Each longitudinal fastener 15 runs through a turning member 16. The turning member 16 includes a horizontal coupling end 161 and a vertical fastening end 162. The coupling end 161 has a coupling hole 163 coupled with an elastic shock-absorbing pad 17. The longitudinal fastener 15 runs through the shock-absorbing pad 17 to fasten to the lug 14. The fastening end 162 of the turning member 16 at the upper side of the drum shell 13 is bent on the top to form an upper butting flange 164*a*, and the fastening end 162 of the turning member 16 at the lower side of the drum shell 13 is bent at the bottom to form a lower butting flange 164*b*.

The coupler 20 includes a first coupler 21, a second coupler 22, and a distance adjustment means 30 which longitudinally couples the first and second couplers 21 and 22.

The first coupler 21 is an arched plate surrounding the circumference of the drum shell 13 at the upper side, and has elongate adjustment slots 211 on the left side and right side, each adjustment slot 211 run through by a transverse fastener 212 (such as a bolt). The transverse fastener 212 has a polygonal head 213 (such as square) to be coupled with a socket type tool (not shown in the drawings) for turning. The transverse fastener 212 also has a distal end fastened to the fastening end 162 of the turning member 16 at the upper side of the drum shell 13. Therefore, the left and right sides of the first coupler 21 can be coupled to two opposing longitudinal fasteners 15 outside the drum shell 13 at the upper side. The top of the first coupler 21 is butted by the upper butting flange 164*a* of the fastening end 162 of the turning member 16 at the upper side.

The second coupler 22 is an arched plate surrounding the circumference of the drum shell 13 at the lower side, and has elongate adjustment slots 221 on the left side and right side, each adjustment slot 221 run through by another transverse fastener 222 (such as a bolt). The transverse fastener 222 has a polygonal head 223 (such as square) to be coupled with a socket type tool (not shown in the drawings) for turning. The transverse fastener 222 also has a distal end fastened to the fastening end 162 of the turning member 16 at the lower side of the drum shell 13. Therefore, the left and right sides of the second coupler 22 can be coupled to two opposing longitudinal fasteners 15 outside the drum shell 13 at the lower side. The bottom of the second coupler 22 is butted by the lower butting flange 164*b* of the fastening end 162 of the turning member 16 at the lower side.

The distance adjustment means 30 includes a first guiding member 31 and a second guiding member 32 that are plates. The first guiding member 31 surrounds the outer side of the second guiding member 32 in an up and down manner and staggered on an outer side and inner side. The upper end of the first guiding member 31 and the first coupler 21 are run through by at least one coupling element such as a screw 311 which has a distal end fastened to a nut 312. The first guiding member 31 has a left side and a right side bent towards the drum 10 to form respectively a first side plate 313 which has an elongate longitudinal guiding slot 314 formed thereon.

The lower side of the second guiding member 32 and the second coupler 22 are run through by at least one coupling element such as a screw 321 which has a distal end fastened to a nut 322. The second guiding member 32 has a left side and a right side bent towards the drum 10 to form respectively a second side plate 323 which has an aperture 324 formed on an upper side thereof. Two fastening elements such as screws 325 are provided, each screw 325 has a screw head 326 at one end formed at a diameter greater than that of the screw 325, the screw 325 runs through the guiding slot 314 and aperture 324 to fasten to a nut 327. The second guiding member 32 further has an elongate longitudinal slot 328 in the middle with an open end.

There is another fastening element such as a screw 33 has a screw head 331 at one end formed at a diameter greater than that of the screw 33, the screw 33 couples with at least one washer 332 and runs through the slot 328 and the first guiding member 31 to fasten to a nut 333 to couple the first and second guiding members 31 and 32 together.

The first guiding member 31 has a fixture 40 at one side remote from the drum 10 to couple to a drum stand (not shown in the drawings).

Figure 5A:
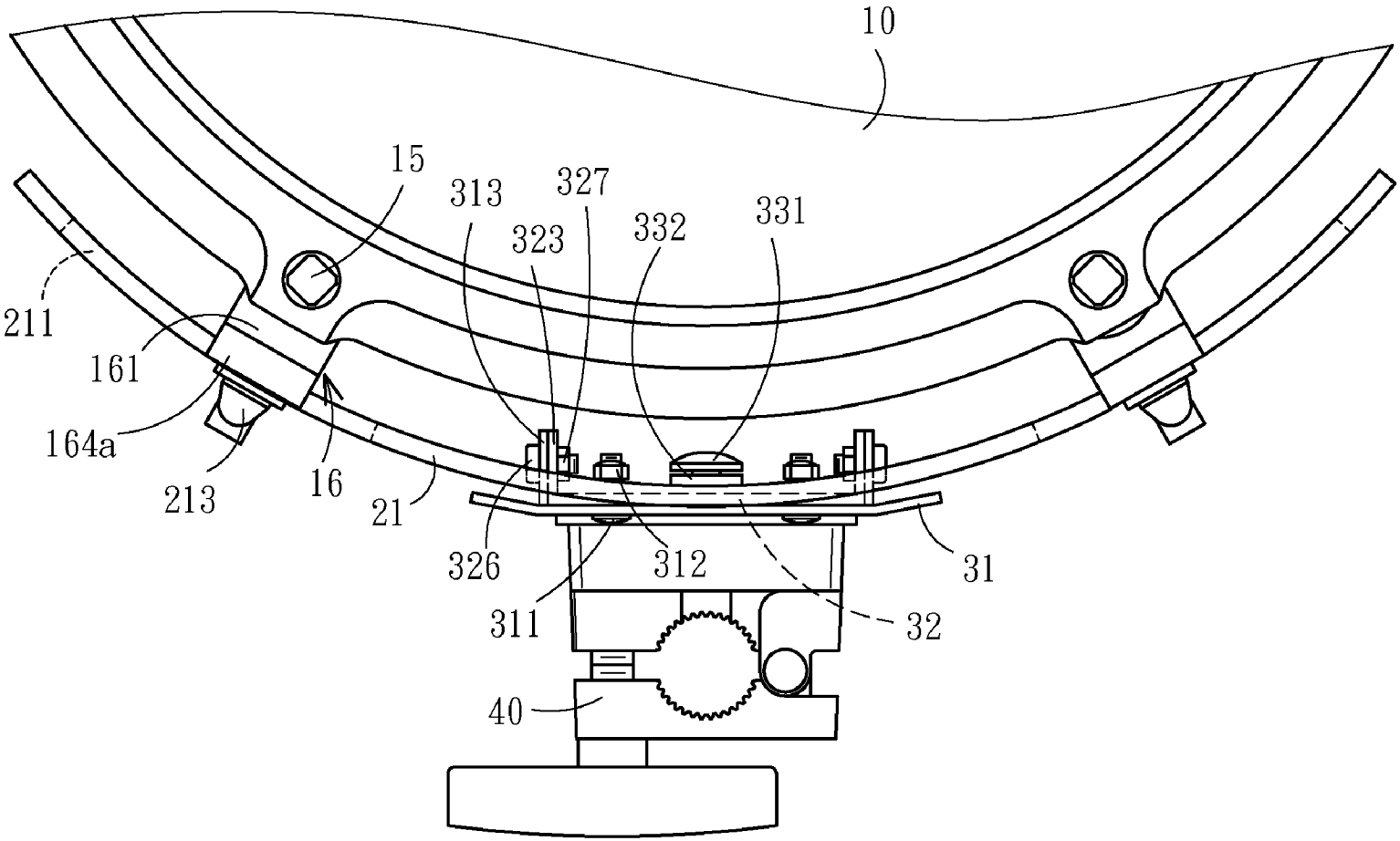
FIG. 5A is a fragmentary top view of the coupler fastening to a smaller drum according to the present invention.
Figure 5B:
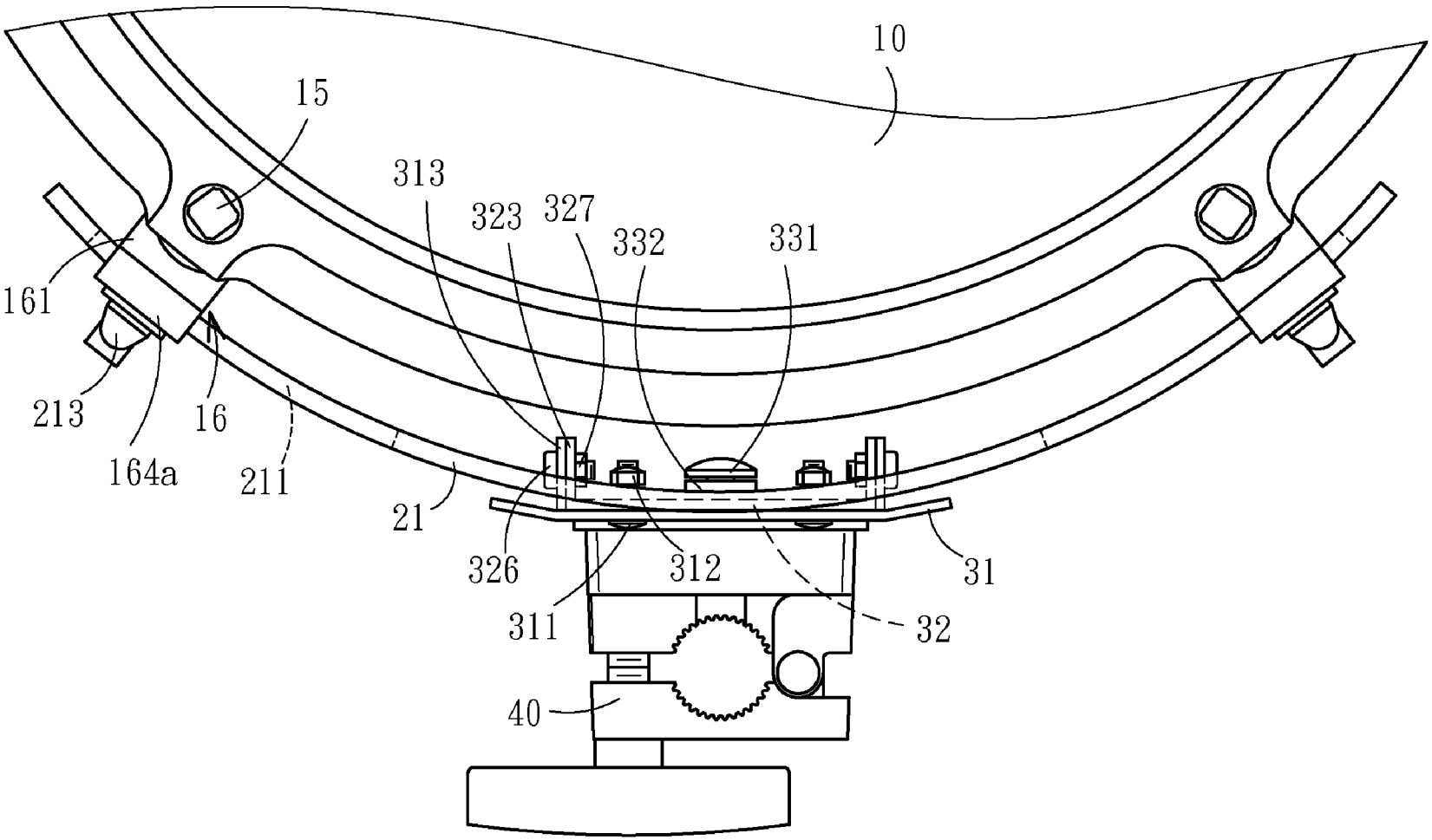
FIG. 5B is a fragmentary top view of the coupler fastening to a larger drum according to the present invention.

By means of the construction set forth above, the first and second couplers 21 and 22 respectively surround the drum shell 13 on the outer side at the upper side and lower side, and have respectively the adjustment slots 211 and 221 on the left and right sides run through by the transverse fasteners 212 and 222 that have distal ends fastened to the fastening end 162 of the turning member 16, therefore can couple with the drum 10 together. As the drums 10 of varying sizes have the drum shells 13 with different diameters, referring to FIGS. 2, 5A and 5B, every two lugs 14 are spaced from each other at a different distance and the arched distance of the two longitudinal fasteners 15 also varies. Since the adjustment slots 211 and 221 are elongate through slots and formed in an arched shape, they allow the transverse fasteners 212 and 222 to adjust positions and form fastening. Moreover, the turning member 16 can be turned relative to the longitudinal fastener 15 to adjust angle as desired. Thus the present invention can be coupled with the drum stand for different drums 10 with the drum shells 13 of greater size differences.

It is to be noted that the first and second guiding members 31 and 32 are coupled in an up and down manner and staggered at the outer side and inner side, thus the distance between the first and second couplers 21 and 22 can be adjusted according to different heights of the drums 10. When in use, unfastening the nut 327 of the screw 325 and the nut 333 of the screw 33, the first coupler 21 can be moved upwards or downwards to mate the heights of the drums 10 of different specifications by adjusting the elevation distance of the first and second couplers 21 and 22. The transverse fasteners 212 and 222 at the upper and lower sides of the drum shell 13 can also mate the fastening end 162 of each turning member 16, then the nut 327 of the screw 325 and the nut 333 of the screw 33 can be fastened tightly to couple the first and second couplers 21 and 22 together.

In the present invention, the screw 33 is fastened in the middle of the first and second guiding members 31 and 32. The two screws 325 are fastened on the left and right sides of the side plates 313 and 323 of the first and second guiding members 31 and 32. Thus a three-point fastening is formed to fasten the first and second couplers 21 and 22 together. As the first and second guiding members 31 and 32 are plates in contact with each other on the outer side and inner side, the present invention provides a greater strength and can prevent vibrating when in use. Compared with the conventional coupler which provides merely fastening through a bolt 9 on two side plates 6 on the left and right sides, the first and second couplers 21 and 22 of the present invention provides more secured fastening.

What is claimed is:

1. A drum and drum stand coupler to couple a drum which includes an upper drum rim and a lower drum rim and a drum shell attached annularly by a plurality of lugs on an outer side thereof at an upper side and a lower side, the upper drum rim and the lower drum rim couples the lugs through a plurality of longitudinal fasteners, the coupler comprising:

a first coupler and a second coupler that are formed in an arched shape and located respectively on an upper circumference and a lower circumference of the drum shell, and include respectively an elongate adjustment slot on a left side and a right side thereof run through by a transverse fastener to couple the longitudinal fastener; and a distance adjustment means which couples longitudinally the first coupler and the second coupler and includes a first guiding member and a second guiding member, the first guiding member containing an upper end coupled to the first coupler, the second guiding member containing a lower end coupled to the second coupler, the first guiding member and the second guiding member being coupled in an up and down manner and staggered on an outer side and an inner side, and run through by at least one fastening element to be coupled together.

2. The drum and drum stand coupler of claim 1, wherein the first guiding member and the second guiding member are plates and contain a left side and a right side that are bent towards the drum to form respectively a side plate, the first guiding member surrounding the second guiding member on an outer side, the side plate of the first guiding member including a longitudinal guiding slot, the side plate of the second guiding member including an aperture, the fastening element being a screw which includes a screw head at one end formed at a diameter greater than that of the screw, and the screw runs through the guiding slot and the aperture to fasten to a nut.

3. The drum and drum stand coupler of claim 2, wherein the first guiding member includes a fixture at one side remote from the drum to couple to a drum stand.

4. The drum and drum stand coupler of claim 1, wherein the longitudinal fastener runs through a turning member which includes a horizontal coupling end and a vertical fastening end, the transverse fastener including a polygonal head and running through the adjustment slot to fasten to the fastening end of the turning member, the polygonal head being couplable with a socket type tool.

5. The drum and drum stand coupler of claim 4, wherein the fastening end of the turning member at the upper side of the drum shell includes a top bent to form an upper butting flange to couple with the top of the first coupler, and the fastening end of the turning member at the lower side of the drum shell includes a bottom bent to form a lower butting flange to couple with the bottom of the second coupler.

6. The drum and drum stand coupler of claim 4, wherein the coupling end includes a coupling hole which couples an elastic shock-absorbing pad run through by the longitudinal fastener.

7. The drum and drum stand coupler of claim 1, wherein the first guiding member includes an upper side run through by at least one coupling element to fasten to the first coupler, the second guiding member including a lower side run through by at least one other coupling element to fasten to the second coupler.

8. The drum and drum stand coupler of claim 7, wherein the coupling elements of the first and second guiding members are screws which include respectively a distal end fastened to a nut.

9. The drum and drum stand coupler of claim 1, wherein the second guiding member includes an elongate longitudinal slot formed with an open end, the fastening element being a screw which includes a screw head at one end formed at a diameter greater than that of the screw, the screw being coupled with at least one washer and running through the slot and the first guiding member to fasten to a nut.

* * * * *